US006619564B1

(12) United States Patent
Brown

(10) Patent No.: US 6,619,564 B1
(45) Date of Patent: Sep. 16, 2003

(54) ORBITAL SPRAY ASSEMBLY

(76) Inventor: Johnnie Weldon Brown, Rte. 1, Comanche, OK (US) 73529

( * ) Notice: Subject to any disclaimer, the term of this patent is extended or adjusted under 35 U.S.C. 154(b) by 0 days.

(21) Appl. No.: 10/195,439

(22) Filed: Jul. 16, 2002

(51) Int. Cl.[7] ..... B05B 3/00

(52) U.S. Cl. ..... 239/263.1; 239/225.1; 239/263.3; 239/380

(58) Field of Search ..... 239/222, 222.21, 239/225.1, 261, 263.1, 263.3, 264, 332, 380, 383, 389

(56) References Cited

U.S. PATENT DOCUMENTS

| | | | | | |
|---|---|---|---|---|---|
| 1,586,997 | A | | 6/1926 | Hull | |
| 3,561,398 | A | * | 2/1971 | Rose et al. | 118/680 |
| 3,883,073 | A | * | 5/1975 | Ballu | 239/77 |
| 4,244,523 | A | | 1/1981 | Looper | 239/227 |
| 4,651,925 | A | | 3/1987 | Harris | 239/239 |
| 4,659,018 | A | * | 4/1987 | Shulman | 239/264 |
| 4,662,565 | A | * | 5/1987 | Waldrum | 239/236 |
| 4,744,517 | A | * | 5/1988 | Iwamoto et al. | 239/263 |
| 4,761,039 | A | * | 8/1988 | Hilaris | 299/36.1 |
| 4,811,902 | A | * | 3/1989 | Nagata | 239/240 |
| 4,944,457 | A | | 7/1990 | Brewer | 239/242 |
| 4,971,084 | A | | 11/1990 | Smith et al. | 134/45 |
| 5,103,761 | A | * | 4/1992 | Ishibashi et al. | 118/323 |
| 5,188,293 | A | | 2/1993 | Burton | 239/227 |
| 5,853,127 | A | | 12/1998 | Heembrock | 239/227 |
| 5,865,374 | A | * | 2/1999 | Barta et al. | 239/263.1 |
| 5,887,800 | A | * | 3/1999 | McClosky | 239/587.1 |
| 5,938,123 | A | * | 8/1999 | Heitzman | 239/383 |
| 6,082,634 | A | | 7/2000 | MacNeil | 239/263 |
| 6,270,586 | B1 | | 8/2001 | Soble | 134/32 |
| 6,499,673 | B1 | * | 12/2002 | Braun et al. | 239/263.1 |
| 2001/0038039 | A1 | * | 11/2001 | Schultz et al. | 239/1 |

* cited by examiner

*Primary Examiner*—Gregory L. Huson
*Assistant Examiner*—Amanda R. Flynn
(74) *Attorney, Agent, or Firm*—Stevens, Davis, Miller & Mosher, LLP

(57) ABSTRACT

An assembly for spraying a fluid along an orbital path generally consisting of a support member, an elongated member universally connected to the support member intermediate the ends thereof, a drive shaft having a crank arm mounted thereon for rotational movement therewith, a universal connection between the crank arm and the end of the elongated member and an opposite end of the elongated member having a fluid passageway provided with an inlet connectable to a fluid supply line and at least one outlet.

21 Claims, 4 Drawing Sheets

ORBITAL SPRAY ASSEMBLY

This invention relates to a spray assembly and particularly to a spray assembly suitable for use in the car wash industry.

BACKGROUND OF THE INVENTION

In the car wash industry, spray assemblies commonly are used to apply cleaning and waxing solutions to the bodies of vehicles, and rinsing such bodies with high velocity streams of water. In the past, such assemblies have been deployed along the path of a vehicle advanced through a car wash system, and mounted in fixed positions or arranged to oscillate. More recently, such spray assemblies have been designed to provide high velocity streams of fluid in orbital patterns. Such orbital spray assemblies have been found to be particularly effective in not only providing a larger area of coverage but reaching previously, not easily accessible areas such as wheel wells and the underbodies of vehicles. While such recently developed spray assemblies have been found to be highly advantageous in providing an improved cleaning performance, they further have been found to have a number of disadvantages. They often have been found to be complicated in design, expensive to manufacture and often require constant maintenance, principally due to leakage. It thus is the principal object of the present invention to provide an improved orbital spray assembly which is comparatively simple in design, relatively inexpensive to manufacture, highly effective in performance and relatively maintenance free.

SUMMARY OF THE INVENTION

In achieving the aforementioned objective of the invention, the present invention generally provides an assembly for spraying a fluid in an orbital pattern generally consisting of a support member, an elongated member universally connected to the support member intermediate the ends thereof, a drive shaft having a crank arm mounted thereon for rotational movement therewith, a universal connection between the crank arm and an end of the elongated member and the opposite end of the elongated member having a fluid passageway provided with an inlet connectable to a fluid supply line and at least one outlet. Preferably, a number of circumferentially spaced outlets are provided, each of which includes a nozzle disposed at an angle to the longitudinal centerline of the elongated member to provide a large area coverage as the dispensing end of the elongated member is moved along an orbital path.

DETAILED DESCRIPTION OF THE PREFERRED EMBODIMENT

Figure 1:
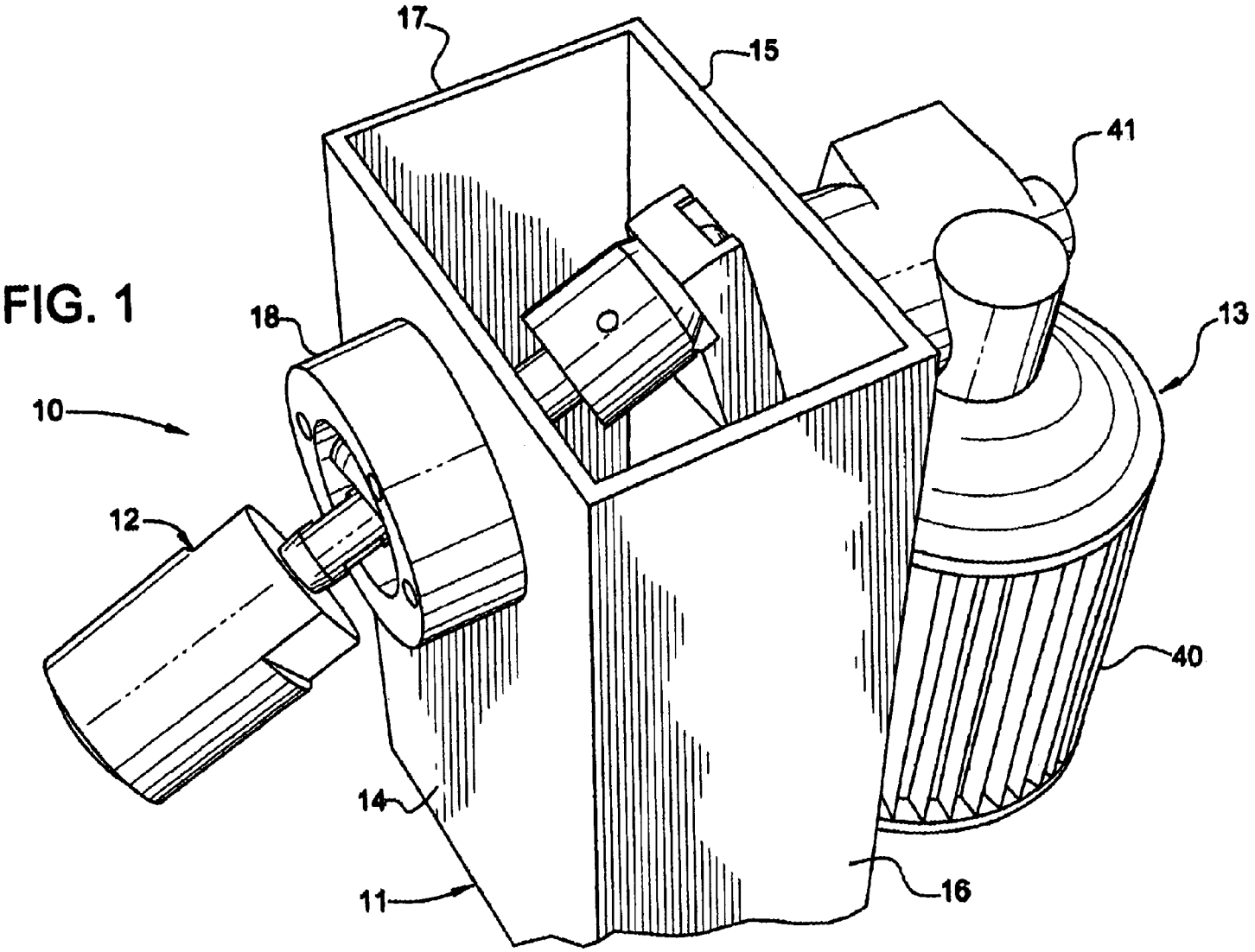
FIG. 1 is a perspective view of an orbital spray assembly embodying the present invention, having a portion thereof broken away.
Figure 2:
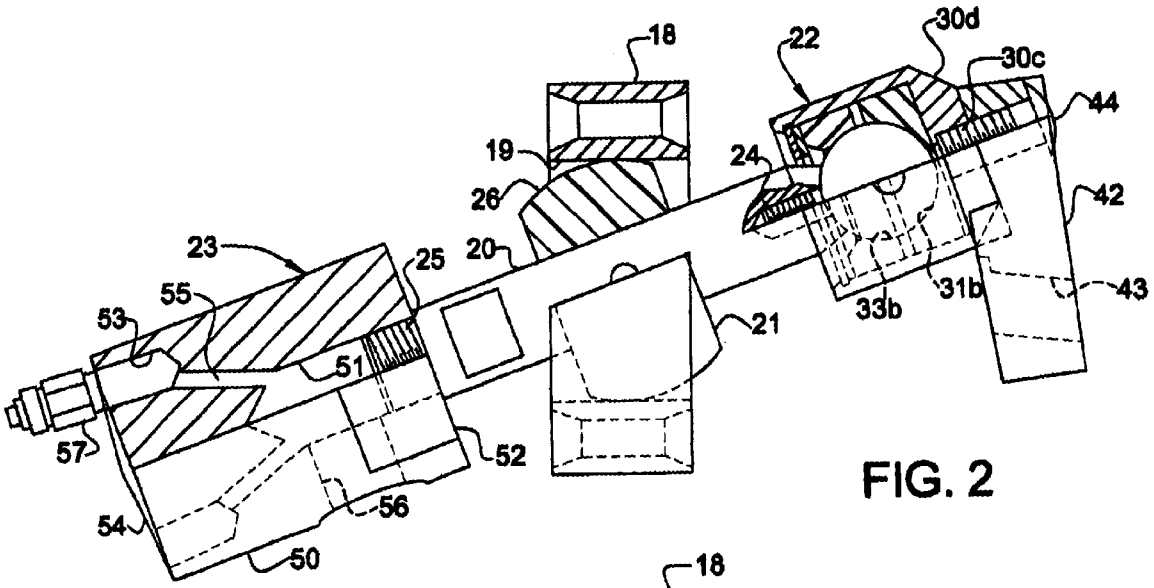
FIG. 2 is a side view of the spray unit of the assembly shown in FIG. 1, illustrating a portion thereof in vertical cross-section.
Figure 3:
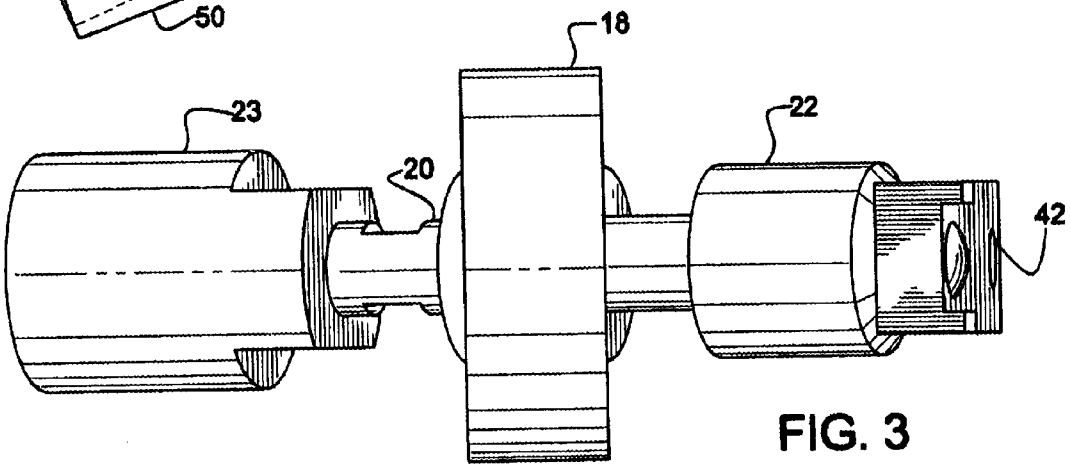
FIG. 3 is a top plan view of the unit shown in FIG. 2.
Figure 4A:
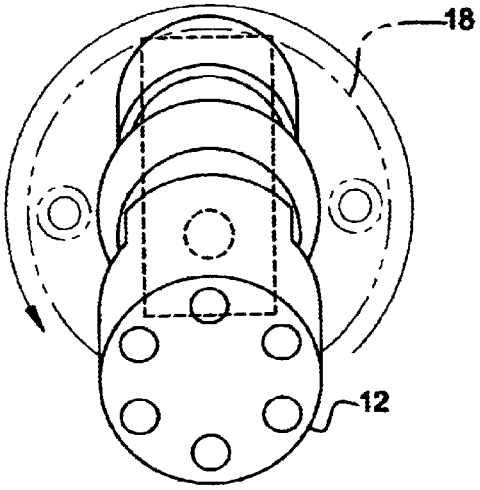
FIGS. 4A through 4D are front views of the unit shown in FIGS. 2 and 3, illustrating the unit in sequential positions along an orbital path.
Figure 4B:
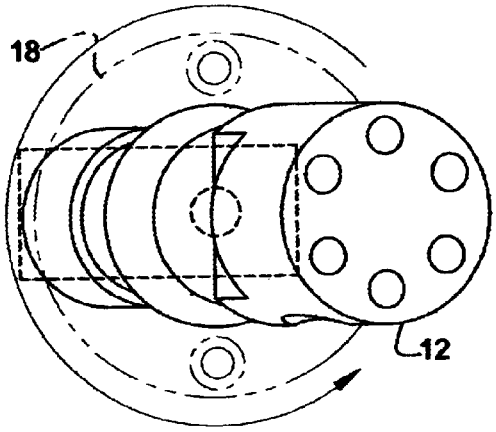
Figure 4C:
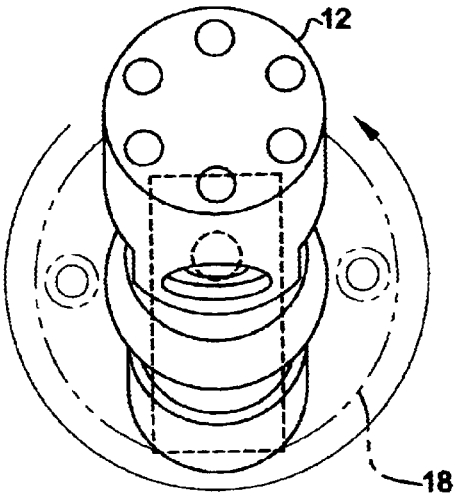
Figure 4D:
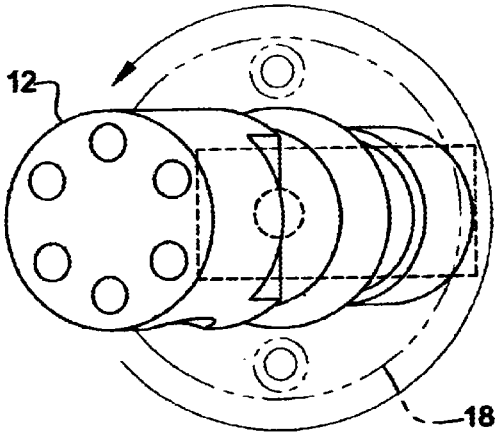

Referring to FIG. 1 of the drawings, there is illustrated an orbital spray assembly 10 suitable for use in a car wash system of the type in which a vehicle is advanced through a tunnel type of structure, which generally includes a support housing 11, a spray unit 12 mounted on the support housing and a motor unit 13 also mounted on the support housing and operatively connected to the spray unit for rotating the ends of the spray unit along orbital paths. Support housing 11 consists of a generally box beam type of structural member including front and rear walls 14 and 15 and a pair of side walls 16 and 17. It may consist of a single, standalone structural member or a component of a larger unit provided with a number of spray units and may be vertically, horizontally or diagonally oriented. In a standalone configuration, it may consist of a short, vertical member supporting one or more spray units for directing streams of fluid to the wheels, wheel wells and underbodies of vehicles. In a more expansive arrangement, it may consist of a U-shape structure supporting a plurality of spray units for directing streams of fluid to the side, upper and end portions of a vehicle advanced through the support structure. In the embodiment shown in the drawings, front wall 14 of the support housing includes an opening through which spray unit 12 extends and an annular bearing seat 18 mounted on the front wall, in alignment with the opening in front wall 14. As best seen in FIG. 2, bearing 18 is provided with an annular bearing seat 19.

Spray unit 12 generally includes an elongated rod member 20, a bearing 21 mounted on the rod member intermediate the ends thereof, a universal connection 22 disposed at an inner end thereof and a spray head 23 mounted on an outer end thereof. Rod member 20 has a cylindrical configuration and includes a threaded, axial bore 24 in the rear end thereof and a threaded front end 25. Bearing member 21 may consist of a separate member having an opening therethrough to permit it to be mounted on rod member 20 and secured thereto by a suitable fastener or may be formed integrally therewith. An outer, bearing surface 26 of the bearing is curved transversely in a plane disposed perpendicular to the longitudinal centerline of rod member 20 and further curved in a plane passing through the longitudinal centerline of the rod member when the bearing member is mounted on the rod, as shown in FIG. 2, to provide a partially spherical bearing surface seated on bearing surface 19. Such partially spherical bearing surface 26 has a diameter substantially equal to the diameter of bearing seat 19 to provide an essentially universal connection between rod member 20 and annular member 18 mounted on the support housing.

Figure 5:
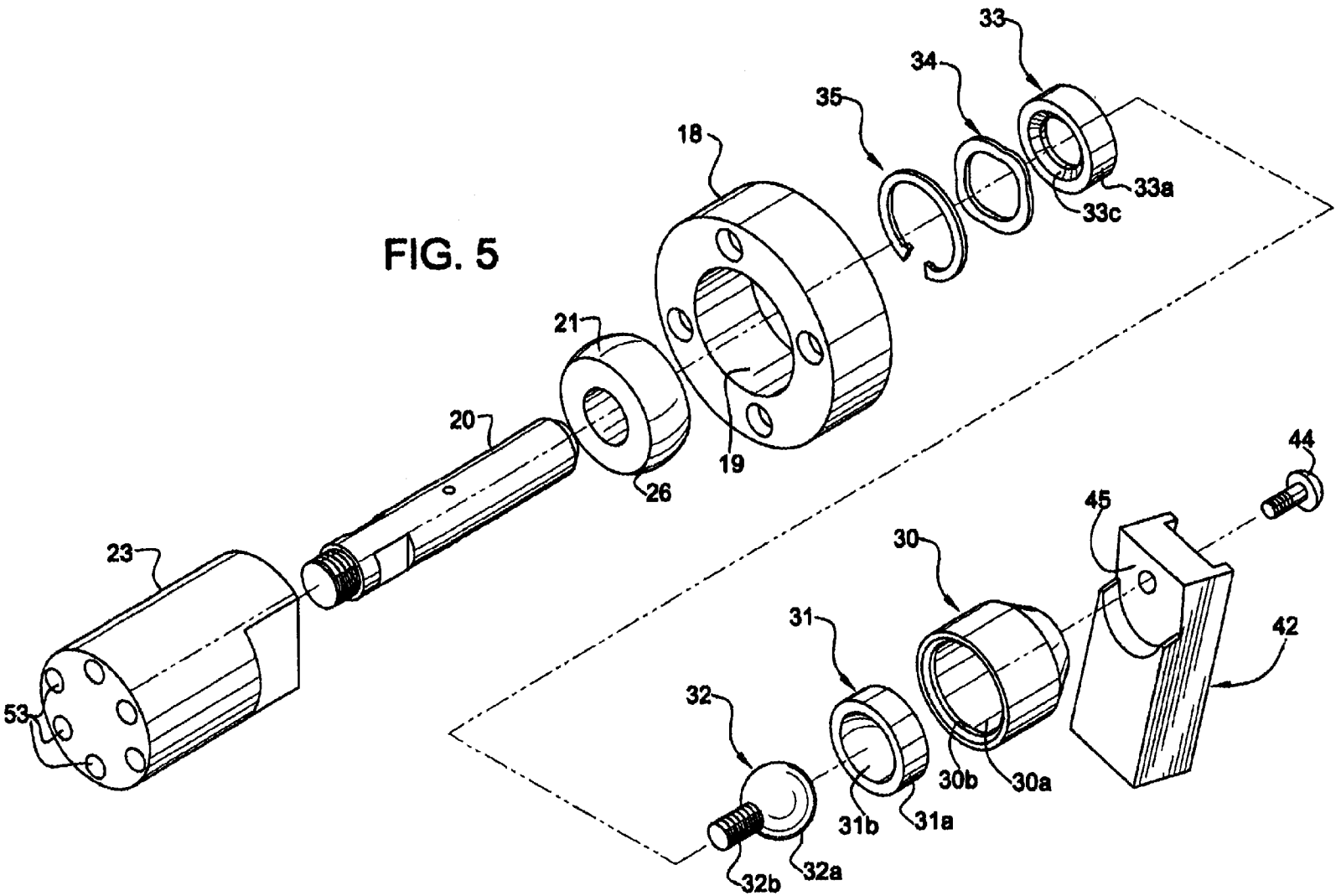
FIG. 5 is a perspective view of the unit shown in FIGS. 2 and 3, illustrating the components in exploded relation.

Universal connection unit 22 is best shown in FIGS. 2 and 5 and will be seen to consist of a housing 30, a first bearing seat section 31, a ball bearing 32, a second bearing seat section 33, a spacer 34 and a retainer ring 35. Housing member 30 has a substantially cup shaped configuration provided with a cylindrical inner wall surface 30*a* provided with an annular recess 30*b* adjacent the open end thereof, a threaded opening 30*c* in the base end thereof disposed coaxially relative to inner surface 30*a* and a beveled rear surface 30*d* at the rear end thereof. Bearing seat section 31 has an annular outer surface 31*a* allowing it to be inserted in housing 21, and a spherical section surface 31*b*. Ball bearing 32 consist of a spherical section 32*a* received within housing 21 and seated on spherical section surface 31*b*, and a radially disposed, threaded portion 32*b*. Bearing seat section 32 is somewhat similar to bearing seat section 31, is received in housing 30 and includes a cylindrical outer surface 33*a*, a spherical section surface 33*b* adapted to engage spherical portion 32*a* of the ball bearing and axially disposed opening 33*c* through which threaded portion 32*b* of the ball bearing projects when unit 21 is in the assembled condition as shown in FIG. 2. Spacer 34 has a substantially annular configuration and is adapted to be received within housing 30 and bear against bearing seat section 31 where it is held in place by retainer ring 35 received within annular slot 30*b* in the interior annular surface of housing 30. Threaded portion 32*b* of ball bearing 32 is threaded into threaded opening 24 at the rear end of the rod member to permit universal displacement of the rod member relative to housing 30.

Motor assembly 13 consists of an electric motor 40 having a housing mounted on the outer side of housing wall 15, and a gear reduction unit 41 having an output drive shaft extending through an opening in housing wall 15 and disposed substantially coaxially with inner bearing seat surface 19 of bearing seat 18. Mounted on the drive shaft is a crank arm 42 having an opening 43 at a lower end thereof for mounting the crank arm on the outer end of the drive shaft within housing 11, and an opening in the outer end thereof through which a bolt 44 extends and is threaded into the threaded opening in housing 30 to rigidly connect housing 30 on the free end of the crank arm. Crank arm 42 is disposed substantially radially relative to the axis of the drive shaft but is angularly displaced a small angle from a plane disposed perpendicular to the axis of the drive shaft. As best shown in FIG. 2, fastening bolt 44 is disposed substantially coaxially relative to rod member 20 when the assembly is in the assembled condition. As best shown in FIG. 5, the upper, forward side of crank arm 42 is recessed as at 45 to accommodate the rear, beveled end of housing member 30.

Spray head member 23 has a cylindrical outer surface 50, a bore 51 in a rear wall 52 thereof disposed coaxially relative to outer wall surface 23, which is partially threaded to receive the threaded end 25 of the rod member therein to mount the spray head on the front end of the rod member, and a plurality of outlets 53 in the front face 54 thereof, spaced circumferentially relative to the axis of bore 51. Intercommunicating bore 51 with outlets 53 is a plurality of passageways 55. Bore 51 also is provided with an inlet 56 to which a fluid supply line (not shown) is connected to supply various fluids under pressure such as cleaning and wax solutions and rinsing water as in car washing applications. Mounted in each of outlets 53 is a nozzle 57 through which fluid under pressure supplied to the spray head is ejected. As best seen in FIG. 2, each of outlets 53 is disposed at a small angle to the longitudinal centerline of the spray unit so that each of the nozzles will eject a stream having a conical configuration with a centerline disposed at a slight angle relative to the longitudinal centerline of the spray unit.

The assembly as described may be quickly and easily assembled by first mounting motor unit 13 on the rear wall of housing 11 with the output shaft thereof extending through an opening in the rear wall, mounting bearing 18 on the front wall of the housing aligned with the opening in the front wall and mounting housing 30 along with bearing seat section 31 inserted therein, on crank arm 42 by means of bolt 44. The crank arm with housing 30 mounted thereon may then be inserted into housing 11 and secured to the output shaft of the motor assembly. Spray unit 12 then may be pre-assembled by threading the nozzles on the spray head, threading the spray head onto the front end of the rod member, sliding bearing 26 onto the free end of the rod member and securing it thereto with a threaded fastener, loosely placing retainer ring 35, spacer 34 and bearing seat section 33 on the rear end of the rod member and then threading the ball member on the end of the rod member. With the spray unit thus pre-assembled, the entire assembly may be completed by extending the unit through bearing 18, allowing bearing 26 to seat on bearing surface 19 and spherical portion 32 of the ball bearing to engage bearing surface 31*b*, sliding bearing section 31 into housing 30 into engagement with ball portion 32, inserting spacer 34 into housing 21 and then securing the ball bearing in housing 21 by means of inserting retainer ring 35 in annular slot 30*b*. Finally, a flexible fluid supply line is attached to the spray head to provide a fluid under pressure through inlet 56, closed bore 51, passageways 55, outlets 53 and nozzles 57 to eject the fluid in a spray pattern.

With the spray assembly assembled as described, the motor assembly may be energized to rotate the arm member. The universal connection of the rear end of the spray unit with the crank arm and the universal connection of the intermediate portion of the rod member with the front housing wall will cause the rotational motion of the crank arm to be translated into an orbital motion of the spray head to provide an orbital spray pattern.

The various components of the assembly may be constructed of any suitable materials. Preferably, the rod member, the ball bearings and the crank arm are formed of sturdy materials such as steel. The various bearing seats and the spray head may be formed of any materials including metallic and plastic materials. The bearings further may be formed of self lubricating materials. The motor assembly may consist of either an electric or hydraulic motor assembly.

The spray assembly as described is simple in design, containing a relatively small number of components, and is easily and quickly assembled. The various components can be either purchased or easily fabricated. Rod member 20, spray head 23, housing 30 and crank arm 42 may be easily machined. Bearing 26 may be formed integrally with the rod member, formed independently or purchased and mounted on the rod member. Bearing seat 18 may be formed or purchased. Nozzles 57 and ball bearing 32 are readily available components that may be purchased. The motor assembly also may be purchased.

As previously indicated, the support structure on which the spray assemblies may be mounted may be of any configuration and the number of spray units mounted thereon may vary. Such units may be deployed in a system such as a car wash system to direct fluid sprays in a plurality of desired patterns. By supplying fluid under pressure directly to the spray head by means of a flexible fluid supply line, leakage of such fluid is minimized if not completely eliminated. Little maintenance of the assembly is required. When it is desired to repair or replace any of the components of any such assembly, such assembly may be readily disassembled, replacement parts may be provided and the components reassembled easily, requiring a small amount of time that a system would be taken out of service.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. An assembly for spraying a fluid along an orbital path, comprising:

a support means;

an elongated member universally connected to said support means intermediate the ends thereof, a drive shaft having a crank arm mounted thereon for rotational movement therewith;

a universal connection between said crank arm and an end of said elongated member; and an opposite end of said elongated member having a fluid passageway provided with an inlet communicable with a fluid supply line and at least one outlet.

2. An assembly according to claim 1 including a motor mounted on said support means and wherein said drive shaft is an output shaft thereof.

3. An assembly according to claim 2 wherein said motor comprises an electric motor.

4. An assembly according to claim 2 including a gear reduction means disposed between said motor and said drive shaft.

5. An assembly according to claim 2 wherein said motor comprises a hydraulic motor.

6. An assembly according to claim 1 wherein said support means includes a first wall on which said first mentioned universal connection is disposed and a second wall in which said drive shaft is supported.

7. An assembly according to claim 1 wherein the axis of rotation of said drive shaft substantially intercepts the center of said first mentioned universal connection.

8. An assembly according to claim 1 wherein said first mentioned universal connection includes an annular bearing surface disposed on said support means and an enlarged portion of said elongated member having a surface curved in longitudinal and transverse planes relative to the longitudinal centerline of said elongated member, seated on said annular bearing surface.

9. An assembly according to claim 1 wherein said first mentioned universal connection comprises a ball and socket connection.

10. An assembly according to claim 1 wherein said second mentioned universal connection comprises a ball and socket connection.

11. An assembly according to claim 1 wherein said crank arm is disposed substantially radially relative to the axis of rotation of said drive shaft.

12. An assembly according to claim 1 wherein said crank arm is disposed at a small angle relative to a plane disposed perpendicular to the axis of rotation of said drive shaft.

13. An assembly according to claim 1 wherein said outlet is disposed at an angle relative to the longitudinal centerline of said elongated member.

14. An assembly according to claim 1 including a nozzle disposed in said outlet.

15. An assembly according to claim 14 wherein said nozzle is disposed at an angle relative to the longitudinal centerline of said elongated member.

16. An assembly according to claim 1 including a spray head mounted on said elongated member, including said fluid passageway and said inlet and outlet thereof.

17. An assembly according to claim 16 wherein said spray head includes a plurality of circumferentially spaced outlets.

18. An assembly according to claim 17 wherein each of said outlets is disposed at an angle to the longitudinal centerline of said elongated member.

19. An assembly according to claim 17 including a set of nozzles disposed in said outlets.

20. An assembly according to claim 19 wherein each of said nozzles is disposed at an angle relative to the longitudinal centerline of said elongated member.

21. An assembly according to claim 1 wherein said support means comprises a box beam member having forwardly and rearwardly disposed walls, said first mentioned universal connection is disposed in said forwardly disposed wall and said drive shaft is supported on said rearwardly disposed wall.

* * * * *